US012805675B2

(12) United States Patent
Sproll et al.

(10) Patent No.: US 12,805,675 B2
(45) Date of Patent: Nov. 24, 2026

(54) FLOOR NOZZLE APPARATUS AND SUCTION CLEANING DEVICE

(71) Applicant: Alfred Kärcher SE & Co. KG, Winnenden (DE)

(72) Inventors: Markus Sproll, Winnenden (DE); Dominik Scholl, Winnenden (DE); Tobias Geltz, Winnenden (DE); David Thomas, Winnenden (DE)

(73) Assignee: Alfred Kärcher SE & Co. KG, Winnenden (DE)

( * ) Notice: Subject to any disclaimer, the term of this patent is extended or adjusted under 35 U.S.C. 154(b) by 331 days.

(21) Appl. No.: 18/513,130

(22) Filed: Nov. 17, 2023

(65) Prior Publication Data

US 2024/0081589 A1 Mar. 14, 2024

Related U.S. Application Data

(63) Continuation of application No. PCT/EP2021/063329, filed on May 19, 2021.

(51) Int. Cl.
*A47L 9/04* (2006.01)
*A47L 11/40* (2006.01)

(52) U.S. Cl.
CPC ..... *A47L 9/0466* (2013.01); *A47L 11/4044* (2013.01)

(58) Field of Classification Search
CPC ..... A47L 9/0466; A47L 11/4044
See application file for complete search history.

(56) References Cited

U.S. PATENT DOCUMENTS 4,315,344 A * 2/1982 Woodward ..... A47L 9/08 15/345
5,184,372 A * 2/1993 Mache ..... A47L 13/11 15/245

(Continued)

FOREIGN PATENT DOCUMENTS

CN 109953689 7/2019
CN 109953689 A * 7/2019 ..... A47L 9/0477

(Continued)

OTHER PUBLICATIONS

CN-109953689-A—English Machine Translation (Year: 2019).*

*Primary Examiner* — Marc Carlson
(74) *Attorney, Agent, or Firm* — Womble Bond Dickinson (US) LLP

(57) ABSTRACT

A floor nozzle apparatus is provided, including a receiving chamber having a receiving space, at least one cleaning roller arranged in the receiving space and rotatable about an axis of rotation, and a suction connector on which a suction stream acts during operation, wherein there is arranged between the receiving space and the suction connector a funnel-shaped duct device opening into the receiving space by an orifice and connecting to the suction connector or including the suction connector, and wherein the orifice has a width, in a direction of width parallel to the axis of rotation, having at least one of the following: (i) the width of the orifice is at least 30% of a width of the receiving space in the direction of width; (ii) the width of the orifice is at least three times a width of an opening in the suction connector in the direction of width.

29 Claims, 13 Drawing Sheets

(56) References Cited

U.S. PATENT DOCUMENTS

| | | | | |
|---|---|---|---|---|
| 5,497,532 | A * | 3/1996 | Glatz | A47L 9/02 15/415.1 |
| 2002/0162187 | A1* | 11/2002 | Keller | A47L 11/4044 15/345 |
| 2006/0085942 | A1* | 4/2006 | Lee | A47L 11/4044 15/320 |
| 2009/0320234 | A1* | 12/2009 | Stoy | A47L 9/02 15/415.1 |
| 2012/0066858 | A1* | 3/2012 | Krondorfer | H04L 25/4975 15/322 |
| 2013/0111693 | A1* | 5/2013 | Krondorfer | A47L 11/4083 15/320 |
| 2015/0257621 | A1* | 9/2015 | Bantum | A47L 11/4016 15/320 |
| 2016/0302634 | A1* | 10/2016 | Juergens | A47L 11/4036 |
| 2018/0146832 | A1* | 5/2018 | Cornelissen | A47L 9/28 |

FOREIGN PATENT DOCUMENTS

| | | | | |
|---|---|---|---|---|
| DE | 538 356 | | 11/1931 | |
| DE | 10 2005 061 646 | | 6/2007 | |
| DE | 10 2014 115 141 | | 4/2016 | |
| DE | 10 2015 100 699 | | 7/2016 | |
| DE | 10 2015 105 415 | | 10/2016 | |
| DE | 102015105415 | A1 * | 10/2016 | A47L 9/02 |
| DE | 10 2015 108 157 | | 11/2016 | |
| DE | 102017109595 | A1 * | 11/2018 | A47L 9/0477 |
| DE | 10 2018 102 028 | | 8/2019 | |
| EP | 0836826 | | 4/1998 | |
| JP | 9276183 | A | 10/1997 | |
| RU | 2072398 | | 1/1997 | |
| WO | WO 2016/173859 | | 11/2016 | |
| WO | WO-2016173859 | A2 * | 11/2016 | B08B 5/04 |

* cited by examiner

FLOOR NOZZLE APPARATUS AND SUCTION CLEANING DEVICE

CROSS-REFERENCE TO RELATED APPLICATIONS

This application is a continuation of international application number PCT/EP2021/063329, filed on May 19, 2021, which is incorporated herein by reference in its entirety and for all purposes.

BACKGROUND OF THE INVENTION

The invention relates to a floor nozzle apparatus, comprising a receiving chamber having a receiving space that is open to a floor side, at least one cleaning roller that is arranged in the receiving space and is rotatable about an axis of rotation, and a suction connector on which a suction stream acts during operation of the floor nozzle apparatus.

Further, the invention relates to a suction cleaning device.

Suction nozzles are known for example from U.S. Pat. Nos. 4,315,344, 5,497,532, RU 2 072 398 C, U.S. Pat. No. 5,184,372, EP 0 836 826 A2, JP 9276183 A, US 2002/0162187 A, US 2006/085942 A, US 2009/0320234 A or US 2012/066858 A.

US 2013/0111693 A and US 2015/0257621 A each disclose an extractor cleaning machine.

Moreover, suction nozzles are known from US 2016/0302634 A, DE 10 2014 115 141 A1, DE 10 2015 105 415 A1, WO 2016/173859 A3 or DE 10 2015 108 157 A1.

WO 2016/202610 A1 discloses a suction nozzle for a vacuum cleaner.

SUMMARY OF THE INVENTION

In accordance with an embodiment of the invention, a floor nozzle apparatus of the type mentioned in the introduction is provided, in which removal by suction at the receiving space is optimized.

In accordance with an embodiment of the invention, in the case of the floor nozzle apparatus mentioned in the introduction, provision is made that there is arranged between the receiving space and the suction connector a funnel-shaped duct device which opens into the receiving space by way of an orifice and which is connected to the suction connector or comprises the suction connector, and in that the orifice has a width, in a direction of width parallel to the axis of rotation, that has at least one of the following:

- the width of the orifice is at least 30% of a width of the receiving space in the direction of width;
- the width of the orifice is at least twice, and in particular at least three times, a width of an opening in the suction connector in the direction of width.

The duct device provides for a flow-guiding transition from the suction connector to the orifice. By comparison with the suction connector, the orifice is wide in the direction of width.

As a result of the duct device according to the invention, it is possible to achieve a homogeneous flow profile at the receiving space, over a great width of the receiving space in the direction of width, and in particular over the entire width. This enables optimized removal by suction to be achieved.

Further, the duct device makes it possible to achieve a relatively low flow resistance.

This makes it possible to achieve an optimized cleaning result with the cleaning roller. Dirt that is taken up can be guided away in optimized manner.

In particular, it is provided for the width of the orifice to extend over at least 50% of the width of the receiving space and in particular over at least 70% of the width of the receiving space and preferably over at least 80% and preferably over at least 90% of the width of the receiving space, in the direction of width. This allows dirt to be removed by suction in optimized manner.

In particular, the form taken by the duct device is only funnel-shaped in the direction of width. It is provided for a maximum height of the orifice in a direction of height transverse to the direction of width to be smaller than a height of the opening in the suction connector in the direction of height, and in particular the height of the opening is at least twice as large as the maximum height of the orifice. This in particular enables the effect that a cross-sectional surface of the duct device remains constant or continuously decreases in size from the orifice toward the suction connector, enabling a homogeneous flow profile to be achieved for removal by suction at the receiving space.

In particular, the orifice takes the form of a slit having a width in the direction of width that is at least three times larger, and in particular at least five times larger, and in particular at least ten times larger, than a maximum height of the orifice in a direction of height transverse to the direction of width. This enables an optimized flow profile in the receiving space (which is a suction duct). The result is optimized removal by suction and hence an optimized cleaning result.

Favorably, the opening in the suction connector has a round or oval shape. This results in a simple construction. To a certain extent, the duct device provides the transition from the round or oval opening to an in particular slit-shaped orifice.

It is quite particularly advantageous if a cross-sectional width of the duct device between lateral duct walls in the direction of width remains constant or decreases in size from the orifice toward the opening in the suction connector. The cross-sectional width is the spacing between the lateral duct walls in the direction of width. With the appropriate configuration, this enables an optimized flow profile to be achieved.

Further, it is favorable if a cross-sectional height of the duct device between an upper duct wall and a lower duct wall in a direction of height transverse to the direction of width increases from the orifice toward the opening in the suction connector, wherein the lower duct wall faces the floor side and the upper duct wall is opposed to the lower duct wall. This results in an optimized flow result.

In particular, a reduction in the cross-sectional width of the duct device from the orifice toward the opening in the suction connector is correlated with an increase in the cross-sectional height of the duct device from the orifice toward the suction connector such that a cross-sectional surface of the duct device continuously decreases in size from the orifice toward the suction connector.

The result is optimized removal of dirt if a spacing between the duct device and the floor side increases from the orifice toward the suction connector. In particular, this makes it possible to avoid horizontal surfaces on which dirt may accumulate.

In a favorable embodiment, the orifice is at a spacing from the underside of a body of the floor nozzle apparatus, on which the receiving chamber is arranged. This enables optimized guiding away of dirt to be achieved. It is also possible to perform a spinning action on dirt, away from the cleaning roller, through the orifice and into the duct device, in order to ensure optimized removal of dirt.

It is quite particularly advantageous if the duct device has at least one device for guiding away coarse dirt, leading into the receiving space. Basically, it is favorable if the orifice takes the form of a slit having a height that is very much smaller than the width. This makes it possible to achieve a homogeneous flow profile in the receiving space. Fundamentally, this can make it more difficult to take up coarse dirt. If at least one coarse-dirt guiding-away device is additionally present, coarse dirt can for its part be guided away effectively.

Thus, in particular at least one of the following is provided:

- a height of the duct device at the at least one coarse-dirt guiding-away device in a direction of height transverse to the direction of width is greater than a height of the duct device outside the at least one coarse-dirt guiding-away device;
- a height of the orifice at the at least one coarse-dirt guiding-away device is in the range between 5 mm and 30 mm;
- in relation to the direction of width, the at least one coarse-dirt guiding-away device is arranged between a lateral outer end of the duct device and a center plane that is oriented perpendicular to the direction of width, and is in particular at a spacing from the lateral outer end and in particular at a spacing from the center plane;
- at least two and in particular exactly two coarse-dirt guiding-away devices are provided;
- coarse-dirt guiding-away devices are arranged symmetrically in relation to a center plane that lies perpendicular to the direction of width.

As a result of increasing the height of the duct device at a coarse-dirt guiding-away device, it is possible to guide away relatively large particles outside the coarse-dirt guiding-away device which cannot reach the orifice to the duct device. In particular, for this purpose a height of the orifice on a coarse-dirt guiding-away device is between 10 mm and 30 mm.

It is favorable for the guiding away of coarse dirt if the at least one coarse-dirt guiding-away device is arranged at a spacing from both a center plane and also a lateral outer end.

It is quite particularly advantageous if two and in particular exactly two coarse-dirt guiding-away devices are provided. On the one hand, this allows coarse dirt to be guided away in optimized manner. Further, at the orifice the form taken by the duct device can have a relatively high degree of symmetry in order to achieve a homogeneous flow profile in the receiving space even when coarse dirt is being guided away.

It is particularly advantageous if coarse-dirt guiding-away devices are arranged symmetrically relative to a center plane that lies perpendicular to the direction of width.

In a structurally simple embodiment, for the purpose of forming the at least one coarse-dirt guiding-away device, at least one recess is formed in a wall of the duct device. This allows an increase in cross section to be achieved "locally", in the region of the recess. This enables a homogeneous flow profile to be obtained.

It is favorable if at least one of the following is provided:

- the at least one recess is formed in an upper side of the wall of the duct device that is remote from the floor side;
- the at least one recess forms, in respect of an inner space of the duct device, a gutter-like region of increased cross-sectional surface;
- the course of the wall of the at least one duct device is rounded at the at least one recess.

It is then possible to produce a coarse-dirt guiding-away device in a structurally simple manner, wherein the duct device has locally an increased cross section in the region of the coarse-dirt guiding-away device. This does not substantially impair a homogenized flow profile.

In a structurally simple embodiment, the orifice has an underside that faces the floor side and an upper side that is opposite the underside, with at least one of the following:

- the underside has a substantially rectilinear course;
- the upper side has a course that deviates from the rectilinear course, with steps and/or bulges;
- a spacing between the underside and the upper side is in the range between 2 mm and 30 mm;
- a spacing between the underside and the upper side lies in the range between 2 mm and 15 mm outside any coarse-dirt guiding-away device present.

This produces, in a simple manner, a homogenized flow profile during removal by suction in the receiving space. The duct device can take a structurally simple form.

It is favorable if a height of the orifice in a direction of height transverse to the direction of width lies in the range between 2 mm and 30 mm, and lies in the range between 2 mm and 15 mm outside a coarse-dirt guiding-away device, if there is one. In particular, in that case a height of the orifice in the direction of height lies in the range between 2 mm and 15 mm if any coarse-dirt guiding-away device present is not taken into account. This allows a homogenized flow profile for the receiving space to be achieved in a structurally simple manner.

In an advantageous embodiment, the duct device has at the orifice, relative to the direction of width, a first region that is delimited by a lateral outer duct wall, and a second region that adjoins the first region, wherein the first region has a smaller height than the second region, wherein in particular a width of the receiving space in the direction of width is at least 400 mm. It has been found that in that case homogenization of the flow profile can be improved over the entire width of the receiving space. In particular, the result has been that the flow profile can be homogenized in the case of wide floor nozzle apparatuses (having a width of at least 400 mm).

In particular, it is advantageous if the height of the first region is in the range between 2 mm and 8 mm.

It has further proved favorable if the height of the second region lies in the range between 5 mm and 30 mm and lies in the range between 5 mm and 15 mm outside a coarse-dirt guiding-away device, if there is one. This results in a homogenized flow profile in the receiving space.

It may be advantageous if at least one flow-diversion region is arranged or formed in the duct device. As a result, the flow conditions can be purposefully affected. In particular, it is then possible to achieve minimization of the flow resistance and the obtaining of a homogenized flow profile in the receiving space.

In particular, at least one of the following is provided:

- the at least one flow-diversion region is formed by way of a recess in the duct device;
- the at least one flow-diversion region is at a spacing from the orifice;
- the at least one flow-diversion region is at a spacing from the suction connector;
- the at least one flow-diversion region lies on a center plane;
- the at least one flow-diversion region is symmetrical or asymmetrical relative to a center plane of the duct device, wherein the center plane is oriented, arranged and/or formed perpendicular to the direction of width;

the at least one flow-diversion region has a geometric center point, and an extent of the at least one flow-diversion region away from the center point and perpendicular to the direction of width, wherein this extent is greater than a width of the at least one flow-diversion region parallel to the direction of width at the geometric center point;

a cross-sectional surface of the at least one flow-diversion region, which forms a barrier face for flow, is at most 90% of a total cross section of the duct device including the at least one flow-diversion region;

the at least one flow-diversion region has no edges or is provided with edges;

the at least one flow-diversion region is in the shape of an egg or droplet.

If the at least one flow-diversion region is formed by way of a recess in the duct device, it can be manufactured in a simple manner. The recess may be used to position elements of the floor nozzle apparatus. For example, the recess may be used to provide a securing point for a sliding soleplate on the floor nozzle apparatus.

Optimized flow conditions result if the at least one flow-diversion region is at a spacing from the orifice and at a spacing from the suction connector.

For example, at least the one flow-diversion region lies on a center plane.

Depending on the form taken by the duct device and on the application, the at least one flow-diversion region may be arranged and/or formed symmetrically or asymmetrically relative to the center plane.

In one embodiment, the flow-diversion region is in the shape of an egg or droplet, wherein it has an extent perpendicular to the direction of width that, starting from a geometric center point, is greater than the extent in the direction of width at this geometric center point.

It has been found that an optimized course of flow results if a cross-sectional surface of the at least one flow region, which forms a barrier face for flow, is at most 90% of a total cross section including this barrier face.

Further, it has proved favorable if a drag coefficient for the at least one flow region—that is to say, the $c_w$ value—is less than or equal to 3 with a Reynolds number of 2,300.

It is favorable if the duct device is arranged above a sliding soleplate, relative to the floor side. For example, a recess in the duct device can be used to form a flow-diversion region for the purpose of securing the sliding soleplate.

In one embodiment, it is provided for a drive motor for the at least one cleaning roller to be arranged on a body of the floor nozzle apparatus and for the drive motor to be positioned between the suction connector and the orifice of the duct device, wherein in particular the duct device takes a form that is asymmetrical relative to a center plane perpendicular to the direction of width, for the purpose of providing space for the drive motor. In that case, the duct device has an external shape such that an optimized utilization of space on the floor nozzle apparatus is achieved.

The at least one cleaning roller is for example a brush roller or a textile roller. In an application for carpet cleaning, the cleaning roller is a brush roller. However, it is also possible for example for the cleaning roller to be a textile roller that is fitted with textile and is used in a wet-floor suction cleaning device.

In particular, during a cleaning operation of the floor nozzle apparatus, a suction stream acts on the suction connector, and the at least one cleaning roller rotates. As a result, an optimized cleaning result can be achieved.

It may be provided for the duct device to be formed in one piece. In that case, it can be manufactured in a simple manner and, during manufacture of the floor nozzle apparatus, be positioned on an appropriate body of the floor nozzle apparatus.

It is in particular provided for a cross-sectional surface of the duct device to continuously increase in size from the orifice toward the suction connector.

According to the invention, there is provided a suction cleaning device, which comprises a suction fan device and a floor nozzle apparatus according to the invention, wherein the suction fan device is fluidically connected to the suction connector of the floor nozzle apparatus.

In one exemplary embodiment, the suction cleaning device takes the form of a carpet-brush suction cleaning device. In that case, the cleaning roller is in particular a brush roller.

The suction cleaning device takes the form for example of an upright device that is operable by a user who is standing up. In particular, the floor nozzle apparatus is then arranged such that it is removable from a device body. It is also possible for the suction cleaning device to take the form of a self-propelling and self-steering cleaning device (as a cleaning robot).

The description below of preferred embodiments serves, in conjunction with the drawings, to explain the invention in more detail.

DETAILED DESCRIPTION OF THE INVENTION

Figure 1:
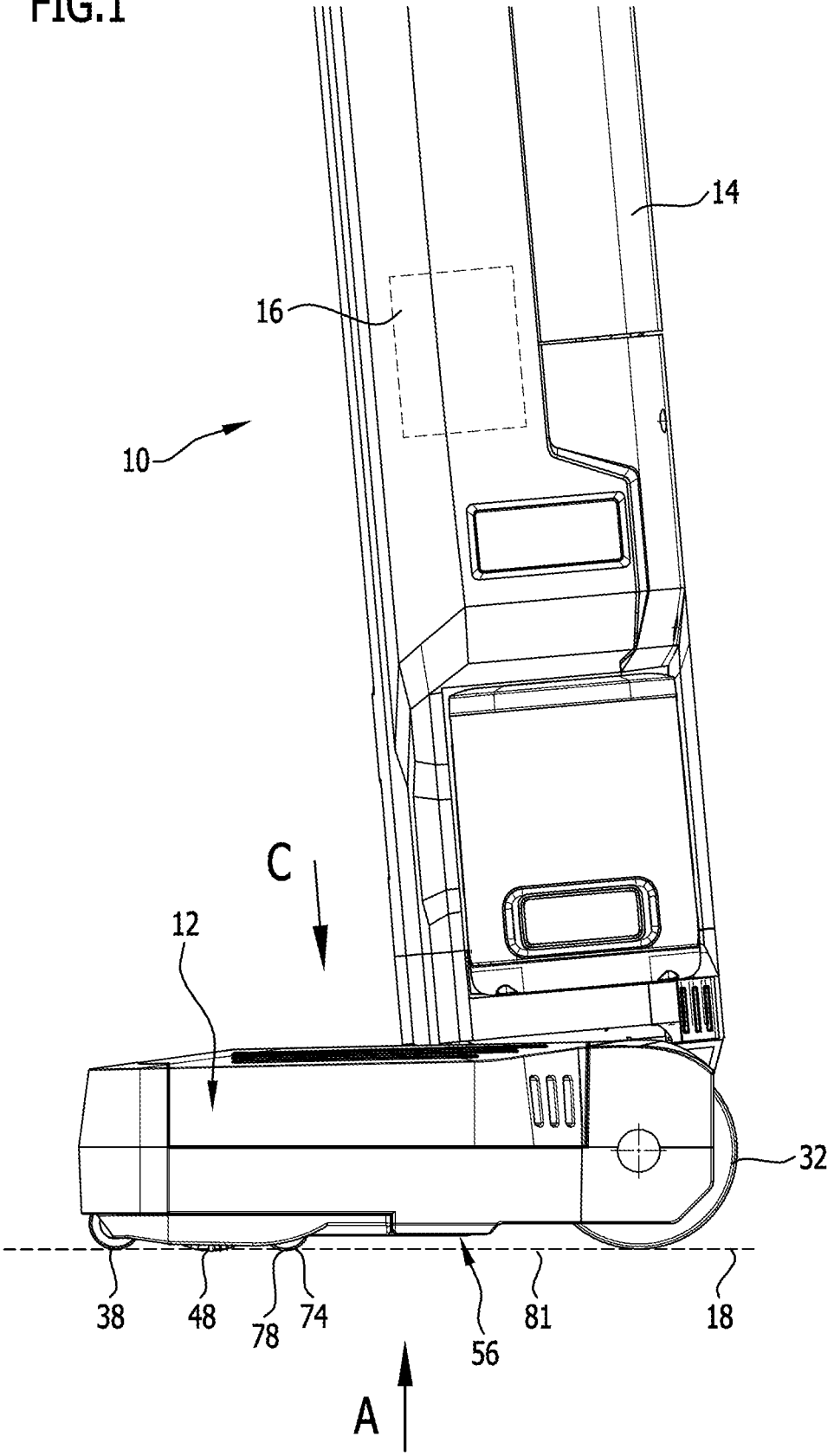
FIG. 1 shows a partial illustration, from the side, of a first exemplary embodiment of a suction cleaning device according to the invention, with an exemplary embodiment of a floor nozzle apparatus according to the invention.

A first exemplary embodiment of a suction cleaning device, shown in a partial illustration in side view in FIG. 1, is a cleaning device of carpet-brush type. The suction cleaning device comprises a floor nozzle apparatus 12. A device body 14 is arranged on the floor nozzle apparatus 12, in particular pivotally.

The suction cleaning device 10 takes the form of an upright device that is operable by a user who is standing up. For this purpose, a corresponding handle device or guiding device (not shown in FIG. 1) is arranged on the device body 14.

Seated on the device body is a suction fan device 16. During a cleaning operation of the suction cleaning device 10, the suction fan device 16 generates a suction stream that acts on the floor nozzle apparatus 12.

The suction cleaning device 10 is set on a floor 18 to be cleaned, by way of the floor nozzle apparatus 12.

The floor nozzle apparatus 12 is detachably or non-detachably connected to the device body 14.

One exemplary embodiment of a floor nozzle apparatus 12 (FIGS. 1 to 6) comprises a body 20. The body 20 has a front end side 22. As seen in a direction of width 24, the body 20 extends between a first transverse side 26 and an opposite second transverse side 28. The front end side 22 lies between the first transverse side 26 and the second transverse side 28.

Arranged on the opposite side of the body 20 to the front end side 22 is a wheel device 30 that has a first wheel 32 and a second wheel 34, at a spacing in the direction of width 24.

In one exemplary embodiment, the body 20 has a smaller width in the region of the wheel device 30 than at the front end side 22.

By way of the wheel device 30, the floor nozzle apparatus 12 and hence also the suction cleaning device 10 is supportable on the floor 18.

Arranged in the region of the front end side 22 is a further wheel device 36. This comprises a first wheel 38 and a second wheel 40, at a spacing from the first wheel 38 in the direction of width 24.

In one exemplary embodiment, the first wheel 32 and the second wheel 34 have the same diameter. The first wheel 38 and the second wheel 40 also have the same diameter, wherein the diameter of the wheel 38 and the second wheel 40 is smaller than the diameter of the wheels 32, 34 of the wheel device 30.

In one exemplary embodiment, the first wheel 32 and the first wheel 38 on the one hand and the second wheel 34 and the second wheel 40 on the other are respectively oriented in alignment in a direction 42 that is perpendicular to the direction of width 24.

During a cleaning operation of the suction cleaning device 10, the floor nozzle apparatus 12 and hence the suction cleaning device 10 are supported on the floor 18 that is to be cleaned by way of the wheel device 30 and the further wheel device 36.

A receiving chamber 44 is arranged on the body 20. The receiving chamber is positioned between the wheel device 30 and the further wheel device 36. In this arrangement it lies closer to the front end side 22 than to the wheel device 30, and closer to the further wheel device 36 than to the wheel device 30.

The receiving chamber 44 comprises a receiving space 46. Positioned at the receiving chamber 44 is a cleaning roller 48, which is mounted in the receiving space 46, rotatably about an axis of rotation 50. The direction of width 24 is parallel to the axis of rotation 50.

In the exemplary embodiment that is shown in FIGS. 1 to 6, a single cleaning roller 48 or a one-portion cleaning roller 48 is provided.

Fundamentally, it is also possible for there to be a plurality of cleaning rollers (in particular having a common axis of rotation 50) or a multi-portion cleaning roller (with the same axis of rotation 50).

In the exemplary embodiment that is shown, the cleaning roller 48 is a brush roller fitted with bristles 52. As a result, a carpeted-floor cleaning device is produced as the suction cleaning device 10.

Fundamentally, in other applications, such as a cleaning device with a mopping function, it is also possible for the cleaning roller to be fitted for example with textile. It is fundamentally also possible for the cleaning roller 48 to be fitted with both bristles 52 and textile.

The body 20 of the floor nozzle apparatus 12 has an underside 54. This underside 54 is a floor side 56 that faces the floor 18 when the floor nozzle apparatus 12 stands properly on the floor 18 by way of the wheel devices 30, 36.

The receiving space 46 is open to the floor side 56 such that the cleaning roller 48 can act on the floor 18 in this region; the receiving chamber 44 has an opening 58 on the floor side 56.

The opening 58 is in particular cohesive and continuous, such that a correspondingly large surface of action of the cleaning roller 48 on the floor 18 that is to be cleaned is provided.

The cleaning roller 48 is mounted on the receiving chamber 44 and hence on the body 20 by way of a pivot bearing 60, such that it is rotatable about the axis of rotation 50. The pivot bearing 60 has a first bearing part **62*a* and a second bearing part 62*b*, which are at a spacing in the direction of width 24 and laterally delimit the receiving space 46, in particular relative to the direction of width 24; the first bearing part 62*a* is associated with the first transverse side 26 and the second bearing part 62*b* is associated with the second transverse side 28**.

In one exemplary embodiment, which is shown in FIGS. 2 to 6, a width of the cleaning roller 48 is smaller in the direction of width 24 than a width of the body 20 in this direction.

In one exemplary embodiment, a drive motor 64 (see FIG. 6) is arranged on the body 20. This drive motor 64 is in particular an electric motor. It is supplied with electrical energy by way of the device body 14. For example, arranged on the device body 14 is a battery device (and in particular a rechargeable battery device) that provides the drive motor 64 with electrical energy. As an alternative or in addition, it is also possible for the device body 14 to have a grid connection and for the drive motor 64 to be provided with electrical energy by way of a corresponding supply device on the device body 14.

In one exemplary embodiment, the drive motor 64 is arranged on the body 20 between the wheel device 30 and the receiving chamber 44 (see FIG. 6), in which case it is arranged in particular closer to the wheel device 30 than to the receiving chamber 44.

A center plane 66 is associated with the floor nozzle apparatus 12. The center plane 66 lies centrally between the first transverse side 26 and the second transverse side 28. It is oriented perpendicular to the direction of width 24 and hence perpendicular to the axis of rotation 50.

The body 20 is geometrically divided into a first half-portion 68 and a second half-portion 70 by the center plane 66, wherein the first transverse side 26 is located on the first half-portion 68 and the second transverse side 28 is located on the second half-portion 70.

In one exemplary embodiment, the drive motor 64 is located in one half-portion. In the exemplary embodiment that is shown, the drive motor 64 is located in the first half-portion 68 (see FIG. 6).

In particular, it is located on the body 20 in front of the first wheel 32.

The drive motor 64 is in particular located on a line that lies perpendicular to the direction of width 24 (in the direction 42), between the first wheel 32 and the first wheel 38.

For the purpose of transmitting torque from the drive motor 64 to the cleaning roller 48 in order to bring about a rotational movement thereof about the axis of rotation 50, a torque transmission device 72 is provided. The torque transmission device 72 bridges a spacing between the drive motor 64 and the cleaning roller 48, in particular in the direction 42.

The torque transmission device 72 is arranged on the same half-portion as the drive motor 64. In the exemplary embodiment that is shown, it is arranged on the first half-portion 68 and thus close to the first transverse side 26.

The torque transmission device 72 is or comprises for example a belt drive.

It is in particular provided for the torque transmission device 72 also to comprise a speed reducer, with the result that a speed of rotation of the cleaning roller 48 is smaller than a speed of rotation of the drive motor 64.

The amount by which a width of the cleaning roller 48 in the direction of width 24 is smaller than a width of the body 20 in the direction of width 24 substantially corresponds to the total of a width of housing walls, a width of the first bearing part 62*a*, a width of the second bearing part 62*b*, and a width of the torque transmission device 72, in each case in the direction of width 24.

Fundamentally, it is also possible for the drive motor 64 to be integrated into the cleaning roller 48 ("roller motor").

Moreover, it is fundamentally possible for the drive motor to be integrated for example into the device body 14 or to be arranged between the device body 14 and the body 20.

In the described exemplary embodiment, the cleaning roller 48 is driven in rotation by way of one side, namely the side facing the first bearing part 62*a* or facing the first transverse side 26.

Fundamentally, it is also possible for example for the drive motor 64 to be arranged such that the cleaning roller 48 is driven centrally.

Arranged on the underside 54 of the body 20 is a sliding soleplate 74. The sliding soleplate 74 is positioned between the receiving chamber 44 and the wheel device 30.

In one exemplary embodiment, the sliding soleplate 74 comprises a first region 76 and a second region 78. The second region 78 is the actual sliding soleplate region, and is fixed to the first region 76 and in particular formed in one piece therewith.

The second region 78 corresponds to the first wheel device 36. The second region 78, which in particular in the direction of width extends over the entire width of the floor nozzle apparatus 12, lies in a plane 81 with the wheel device 30 and the further wheel device 36. Accordingly, during a cleaning operation of the suction cleaning device 10 this is supported on the floor 18 by way of the floor nozzle apparatus 12 through the sliding soleplate 74 together with the second region 78, the wheel device and the further wheel device 36.

Figure 2:
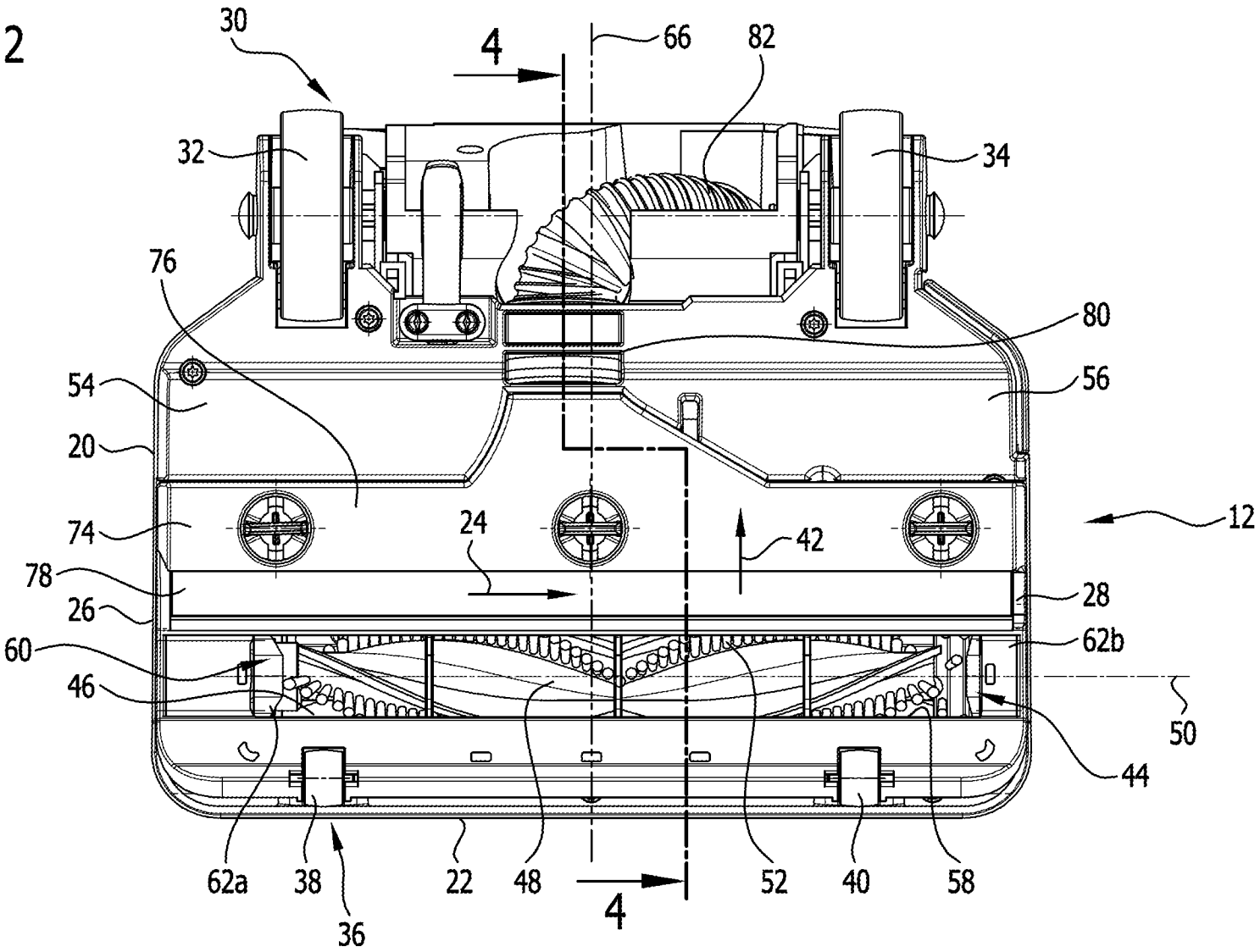
FIG. 2 shows a view from below of the floor nozzle apparatus from FIG. 1, in the direction A.
Figure 3:
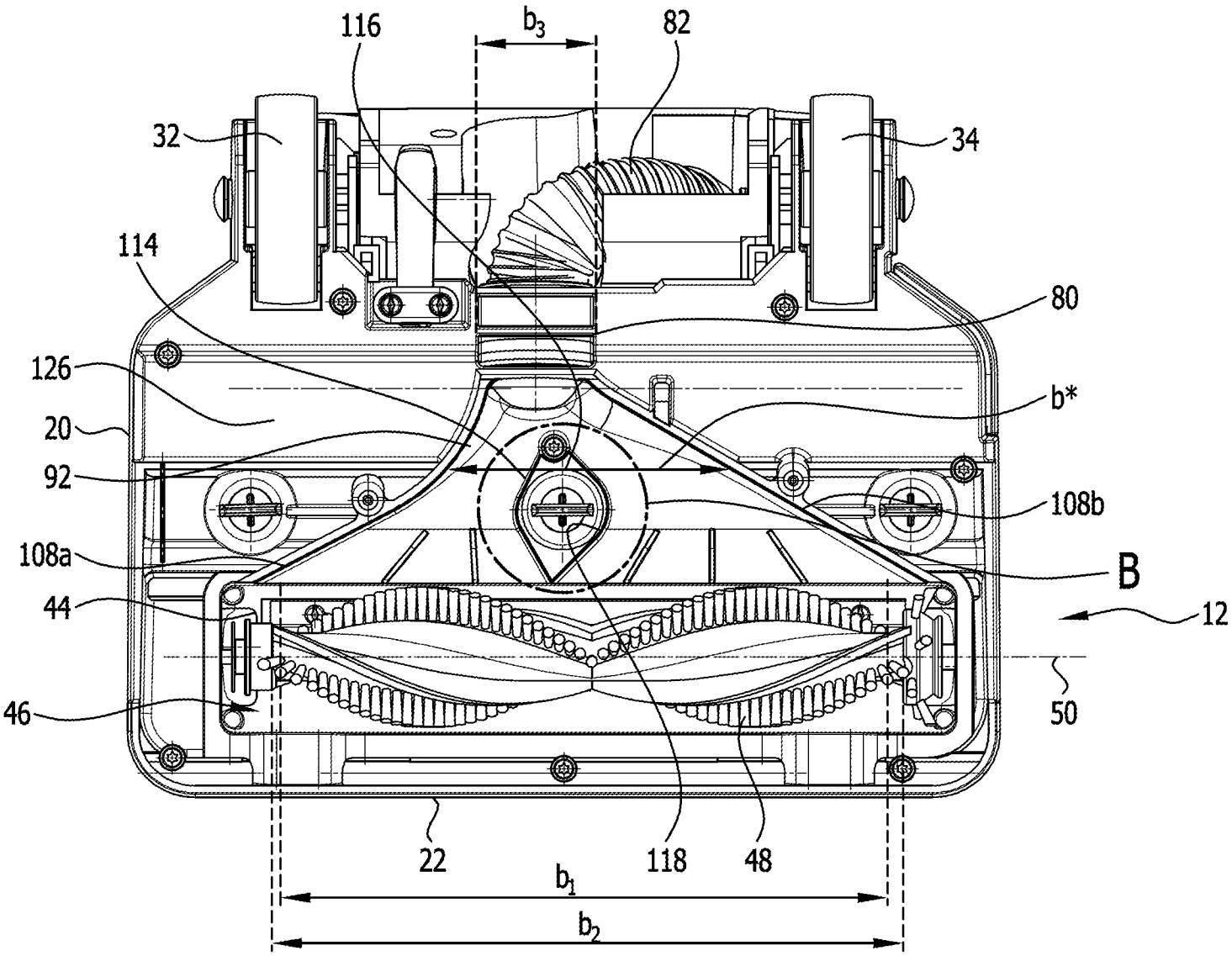
FIG. 3 shows the same view as FIG. 2 with a sliding soleplate removed.

FIG. 3 shows the floor nozzle apparatus 12 from FIG. 2 with the sliding soleplate removed.

The floor nozzle apparatus 12 has a suction connector 80 (see for example FIG. 2) by way of which a suction stream from the suction fan device 16 can be fed into the floor nozzle apparatus 12.

In the exemplary embodiment that is shown, a suction hose 82 is coupled onto the suction connector 80. The suction hose 82 leads from the suction connector 80 to the device body 14 and provides a fluidic connection to the suction fan device 16 for the purpose of causing a suction stream to act on the suction connector 80.

The suction connector 80 comprises an opening 84 through which a suction stream can correspondingly flow. The cross-sectional shape of the opening 84 is in particular round or oval.

In one exemplary embodiment, the opening 84 in the suction connector 80 is oriented transversely and for example perpendicular to the underside 54, or the floor side 56, of the body 20.

In particular, an orifice normal 86 to the opening 84 is oriented parallel to the direction 42, perpendicular to the axis of rotation 50, and perpendicular to the direction of width 24.

In the exemplary embodiment that is described and shown, in particular the suction hose 82 is detachable from the suction connector.

The term "suction connector" is understood here to mean in general a connector for feeding a suction stream into the floor nozzle apparatus 12. It is not necessarily a connector or flange to which for example a hose or tube is connectable. The suction connector 80 may also be formed in one piece with a corresponding suction tube or suction hose.

In the exemplary embodiment that is shown, the suction connector 80 is formed on a pipe socket 88 to which the suction hose 82 is in particular detachably connected.

In one exemplary embodiment, the suction connector 80 is located remote from the front end side 22, and is located in particular on a rear side 90 of the body 20, between the first wheel 32 and the second wheel 34. This provides the appropriate space to guide a suction hose 82 through the intermediate space between the first wheel 32 and the second wheel 34 and to the device body 14.

A duct device 92 is provided which is positioned on the body 20 and provides a fluidic connection between the suction connector 80 and the receiving space 46 (between the opening 84 and the receiving space 46) so that dirt can be removed by suction through the duct device 92; as a result of the duct device 92, the suction stream that is generated by the suction fan device 16 acts on the receiving space 46.

Here, the duct device 92 takes a form such that there is a small flow resistance and as homogeneous as possible a flow profile in the inward suction in the receiving space 46.

The receiving space 46 forms a suction duct that extends in the direction of width 24 and in which the cleaning roller 48 is positioned. During operation of the floor nozzle apparatus 12, this suction duct/receiving space 46 is accordingly acted on by the suction stream that is fed in by way of the duct device 92.

Further, in this context the duct device 92 is preferably arranged and takes a form such that during operation of the floor nozzle apparatus 12, with the cleaning roller 48 rotating, dirt that is entrained by the cleaning roller 48 can so to speak be thrown into the duct device 92.

Figure 4:
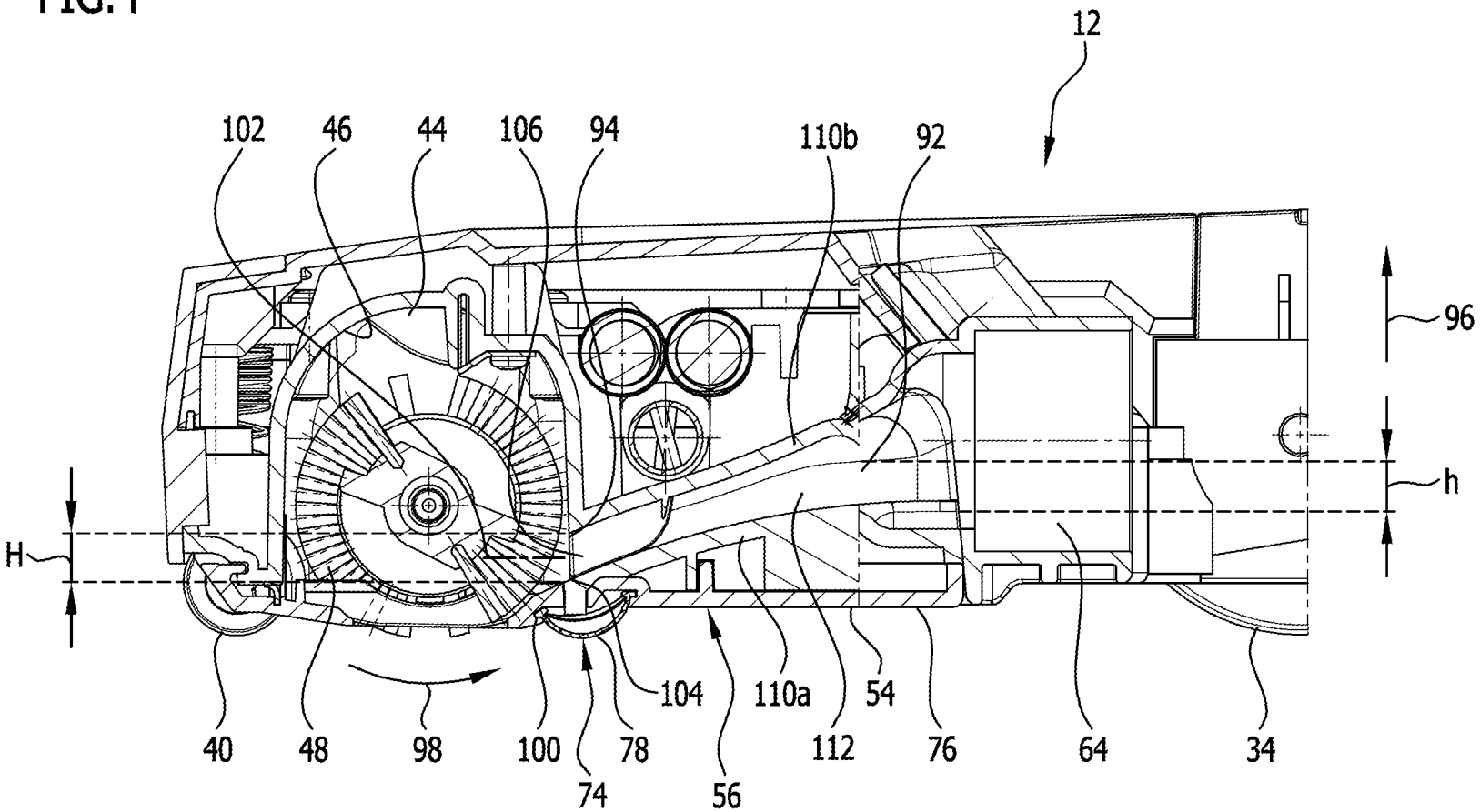
FIG. 4 shows a sectional view along the line 4-4 in FIG. 2.

The duct device 92 opens into the receiving space 46 (suction duct) by way of an orifice 94 (see FIG. 4).

The orifice 94 is located in particular in a direction of height 96 that is perpendicular to the direction of width 24/axis of rotation 50 and perpendicular to the floor side 56, above the sliding soleplate 74 and in particular directly above the second region 78 of the sliding soleplate 74.

The orifice 94 is at a spacing from the underside 54, or the floor side 56, of the body 20.

In this context, a direction of rotation 98 of the cleaning roller 48 for rotation about the axis of rotation 50 is such that a region lying on the floor 18 rotates toward the orifice 94 over the shortest path. In the view that is shown in FIG. 4, the direction of rotation 98 is counter-clockwise. From the point of view of a user who, for proper operation of the suction cleaning device 10, is standing behind the device body 14, the direction of rotation 98 is counter-clockwise.

A guide element 100 is arranged on the receiving chamber 44 in the region of the underside 54 (see FIG. 4), and is oriented in the manner of an oblique plane relative to the floor side 56, aligned with the orifice 94 of the duct device 92. The guide element 100 delimits the opening 58 in the receiving space 46 toward the floor side 56. It serves to support the feeding of dirt into the duct device 92 at the orifice 94 thereof.

The orifice 94 of the duct device 92 into the receiving space 46 has an orifice normal 102 that is perpendicular to the direction of width 24 (perpendicular to the axis of rotation 50).

Further, the orifice normal 102 is parallel to the floor side 56 and to the floor 18 if the floor 18 is flat and the floor nozzle apparatus 12 is properly set up on the floor 18.

The orifice 94 takes the form of a slit and extends in the direction of width 24.

The orifice 94 has an underside 104 and an upper side 106 (see FIG. 4). The underside 104 faces the floor side 56.

The orifice 94 has a width $b_1$. The receiving space 46 has a width $b_2$ in the direction of width 24. The width $b_1$ is at least 30%, preferably at least 50%, preferably at least 70%, preferably at least 80%, and preferably at least 90% of the width $b_2$. Removal by suction from the suction duct (the receiving space 46) takes place over the majority of the receiving space 46.

The duct device 92 is funnel-shaped, starting from the orifice 94 in the direction of width 24. Its width b* in the direction of width 24 between lateral duct walls 108*a*, 108*b* (see FIG. 3) continuously decreases from the orifice 94 (where $b^*=b_1$) to the suction connector 80 (where $b^*=b_3$; see below).

In particular, the width $b_1$ of the orifice 94 is at least twice and preferably three times as large as a width $b_3$ of the opening 84 at the suction connector 80. Preferably, the width $b_1$ is at least four times and in particular at least five times as large as the width $b_3$.

In a preferred embodiment, the duct device 92 is only funnel-shaped in the direction of width 24.

In respect of the direction of height 96, a cross-sectional height h between a lower duct wall 110*a* and an upper duct wall 110*b* continuously increases from the orifice 94 to the opening 84.

The duct device 92 comprises, as duct walls, the lower duct wall 110*a* and the upper duct wall 110*b*, between which lie the lateral duct walls 108*a*, 108*b*. Between these duct walls 108*a*, 108*b*, 110*a*, 110*b* there is formed an inner space 112 of the duct device 92 which is configured for the suction stream to flow through.

Moreover, the duct device 92 is arranged obliquely on the body 20 such that, at least at the transition to the orifice 94, the lower duct wall 110*a* has no horizontal region at which dirt could possibly accumulate.

In particular, the duct device 92 is arranged on the body 20 such that in the direction of height 96 a spacing of the duct device 92 from the floor side 56 (the underside 54) increases from the orifice 94 toward the opening 84 (see FIG. 4).

The orifice 94 has a height H between the underside 104 and the upper side 106, wherein the height H is measured in the direction of height 96.

As a result of the slit-shaped form taken by the orifice 94, the width $b_1$ in the direction of width 24 is at least twice and in particular at least three times larger and in particular at least five times larger and in particular at least ten times larger than the (maximum) height H of the orifice 94.

The height H in particular lies in the range between 5 mm and 15 mm, or in the range between 2 mm and 15 mm if any coarse-dirt guiding-away devices (see below) are not taken into account.

It has been found that this form of the duct device 92, which is funnel-shaped at the transition from the orifice 94 to the opening 84 in the direction of width 24, and which ensures a continuous increase in the cross-sectional height in the direction of height 96 at the transition from the orifice 94 to the opening 84, allows a reduced flow resistance to be achieved, and allows a homogenized flow profile over the entire width of the receiving space 46 (suction duct) to be achieved. This in turn results in optimized removal of dirt.

In particular, in this context the duct device 92 takes a form such that a cross-sectional surface of the duct device 92 is continuously reduced from the orifice 94 to the opening 84.

In one exemplary embodiment, the duct device 92 is made in one part and for example one piece and is fixed to the body 20.

It is provided for a flow-diversion region 114 to be arranged on the duct device 92.

The flow-diversion region 114 serves to adjust the flow conditions. The flow-diversion region 114 is a region that blocks the passage of flow in the inner space 112 of the duct device 92 and must accordingly be flowed around.

In particular, the flow-diversion region 114 is formed by way of a recess 116 in the duct device 92, wherein this recess is delimited by a peripheral wall 118.

Figure 5:
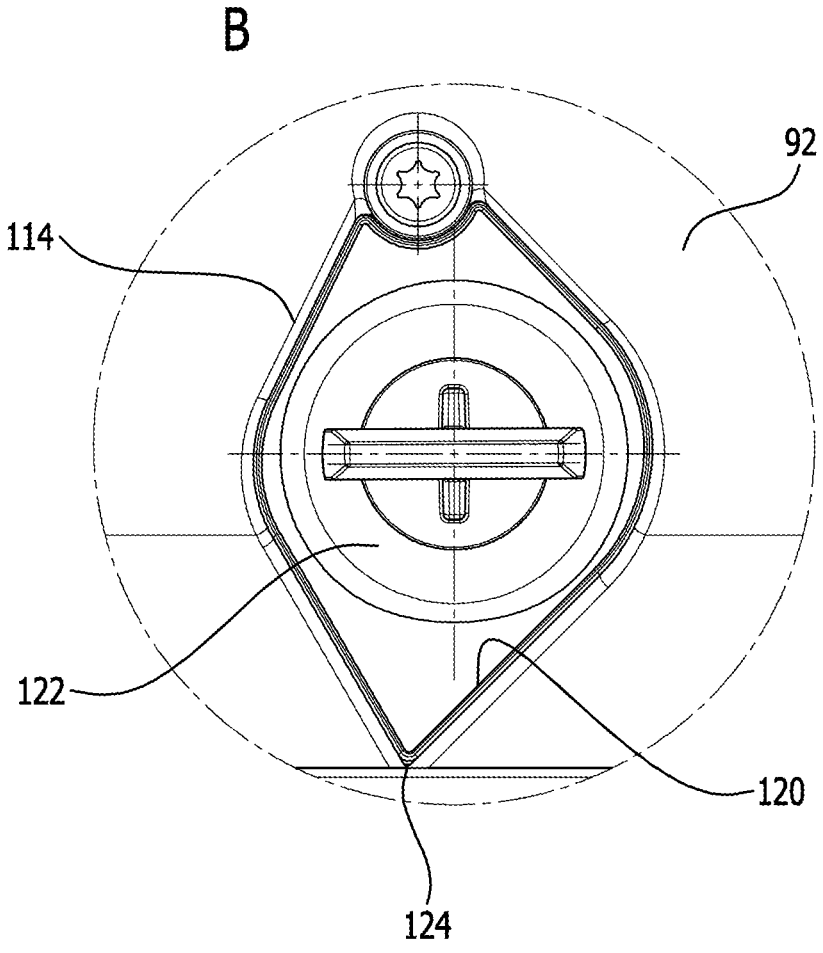
FIG. 5 shows an enlarged illustration of the region B in FIG. 3.
Figure 6:
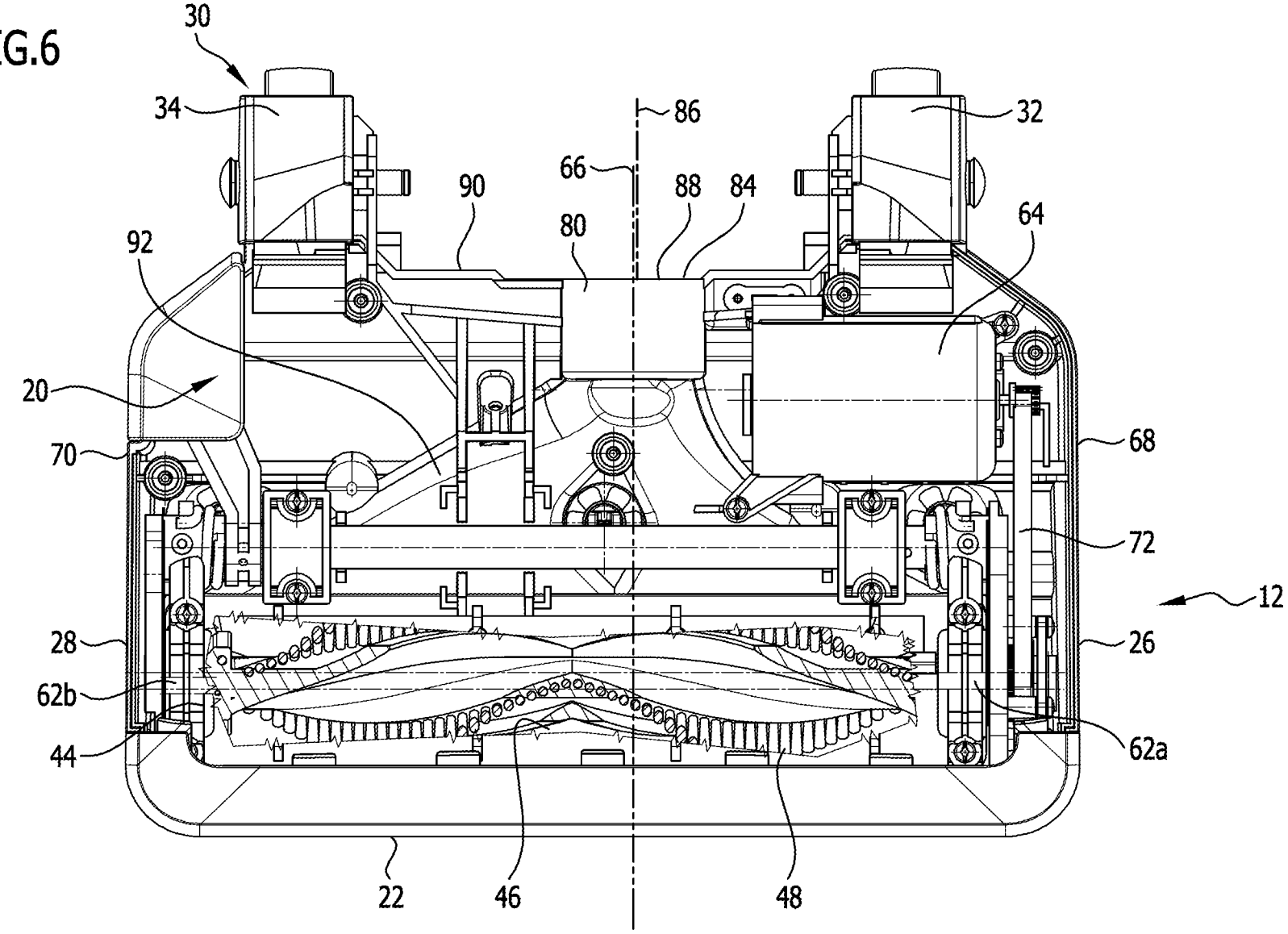
FIG. 6 shows a partial illustration of the floor nozzle apparatus from FIG. 1 in the direction C with components removed.

As a result of the recess 116, a passage through the duct device 92 is provided (see FIG. 5). By way of this passage 120, a securing point 122 for the sliding soleplate 74 is provided on the body 20.

In the exemplary embodiment that is shown, the flow-diversion region 114 is in the shape of a heart. It lies on the center plane 66 and has a pointed edge 124 pointing toward the orifice 94.

In the exemplary embodiment that is shown, the flow-diversion region 114 is not symmetrical in relation to the center plane 66.

The duct device 92 as a whole is not symmetrical in relation to the center plane 66 (see FIG. 3). It is smaller in the region of the first half-portion 68 than in the region of the second half-portion 70, in order to provide an appropriate space 126 (see FIG. 3) for positioning the drive motor 64.

The flow-diversion region 114 takes a form such that, with a Reynolds number of 2,300, it has a drag coefficient $c_w$ that is less than or equal to 3.

Figure 7:
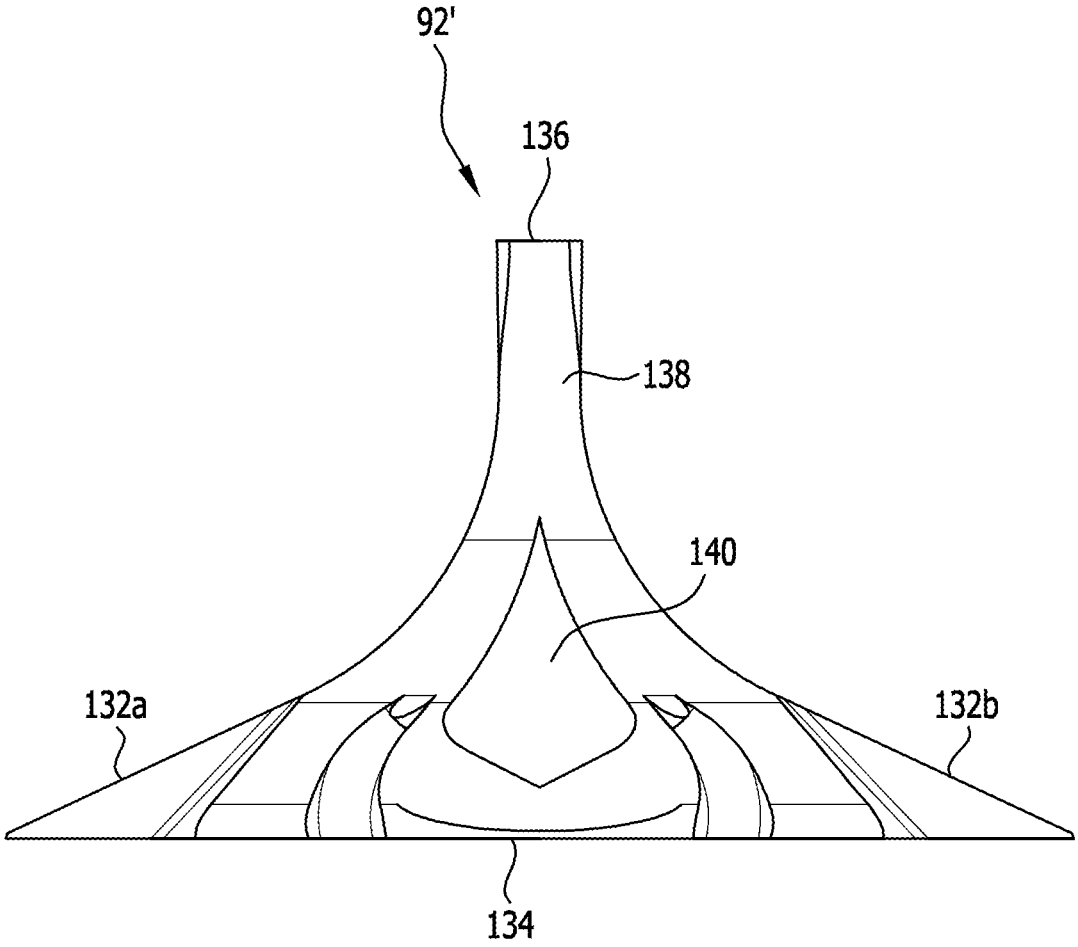
FIG. 7 shows an exemplary embodiment of a duct device, in plan view.
Figure 8:
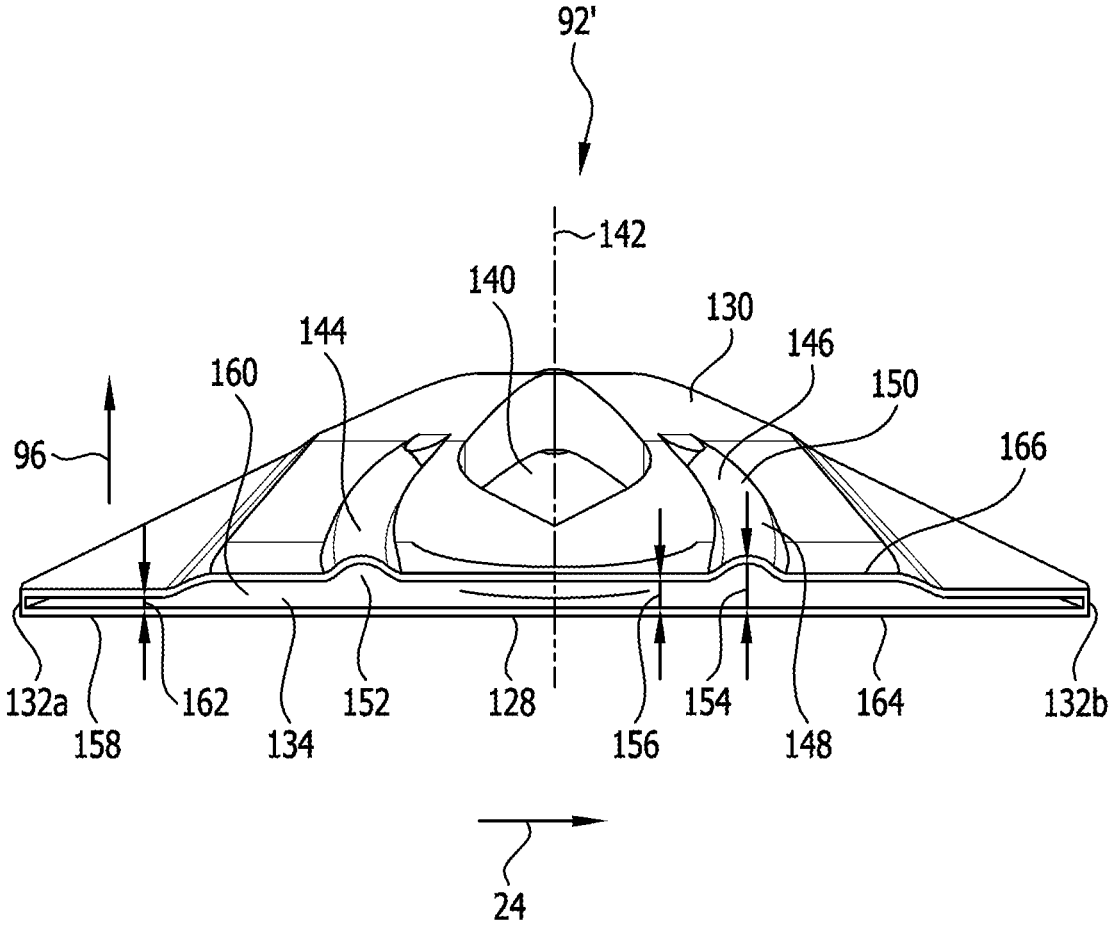
FIG. 8 shows another view of the duct device from FIG. 7.
Figure 9:
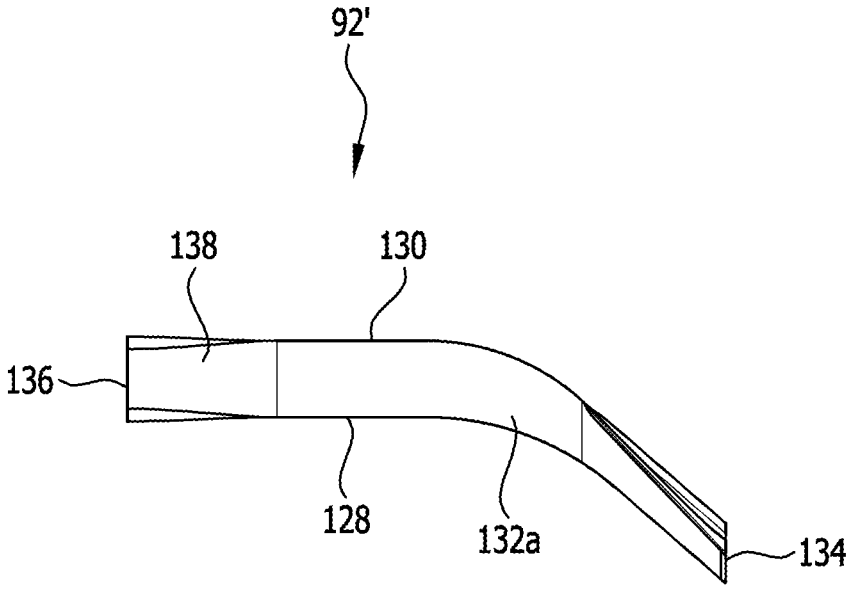
FIG. 9 shows a side view of the duct device from FIG. 7.

An exemplary embodiment of a duct device 92' is shown in FIGS. 7 to 9. This duct device 92' is a variant of the duct device 92 from FIGS. 2 to 6.

The duct device 92' is made in one part and in particular in one piece. This produces simple assembly and securability at the time of manufacture of the floor nozzle apparatus 12.

However, it is also possible for the corresponding duct device 92 or 92' to be made in a plurality of parts and for example to be composed of two half-shells.

The duct device 92' may be arranged on the floor nozzle apparatus 12 instead of the duct device 92.

The duct device 92' has a lower duct wall 128 and an opposite upper duct wall 130. It is delimited by lateral duct walls 132*a*, 132*b*. The duct device 92' comprises an orifice 134 and a suction connector 136. In this context, it takes basically the same form as the duct device 92 that is described above.

The suction connector 136 is formed for example on a pipe socket 138.

The duct device 92' comprises a flow-diversion region 140 that has the shape of a droplet and is formed by way of a recess.

The duct device 92' has a center plane 142 transverse to a direction of width 24 (the same reference numeral is used here as in the case of the duct device 92).

The duct device 92' is formed symmetrically relative to the center plane 142, and the flow-diversion region 140 lies on the center plane 142 and is arranged and formed symmetrically relative thereto.

The duct device 92' has a first coarse-dirt guiding-away device 144 and a second coarse-dirt guiding-away device 146. These are arranged symmetrically relative to the center plane 142.

In a direction of height 96 that is perpendicular to the direction of width 24, the orifice 134 has a greater height at the first coarse-dirt guiding-away device 144 and the second coarse-dirt guiding-away device 146 respectively.

This enables coarse dirt to be taken up and guided away better.

In one exemplary embodiment, the first coarse-dirt guiding-away device 144 and the second coarse-dirt guiding-away device 146 are formed by corresponding recesses 148 in the upper duct wall 130. The recesses 148 are formed by rounded, outwardly projecting wall regions 150. As a result, gutter-like regions 152 of increased cross-sectional surface are formed in the region of the coarse-dirt guiding-away devices 144, 146.

The coarse-dirt guiding-away devices 144, 146 take the form of discrete regions on the duct device 92', wherein an increase in cross-sectional surface that reaches as far as the orifice 134 is achieved locally for the purpose of guiding away coarse dirt. Moreover, this achieves a homogeneous flow profile over a complete width of the suction duct (a complete width of the receiving space 46), wherein relatively large particles are guided away by way of the coarse-dirt guiding-away device 144, 146.

A height 154 of the orifice 134 at a coarse-dirt guiding-away device 144 and 146 respectively lies in the range between 5 mm and 30 mm.

A height 156 of the orifice 134 outside a coarse-dirt guiding-away device 144, 146, and in particular next to such a device, lies in the range between 5 mm and 15 mm, wherein if a coarse-dirt guiding-away device 144, 146 is provided the height 154 is greater than the height 156.

In the case of a variant of an embodiment, the duct device 92' has a first region 158, and a second region 160 that adjoins the first region 158 toward the center plane 142. The first region 158 is an edge region that is laterally delimited by the respective lateral duct walls 132*a*, 132*b*.

A height 162 of the orifice 134 and also of the duct device 92' in the first region 158 is smaller than in the second region 160.

In particular, the height 162 in the first region 158 is in the range between 2 mm and 8 mm. The height 156 in the second region 160 is in the range between 5 mm and 15 mm, wherein the height 156 is greater than the height 162.

From the first region 158 to the second region 160 there is a step-like transition in order to ensure the appropriate increase in height.

As a result of providing the first region 158 and the second region 160, it is possible, in particular where there are wide $b_2$ values of the receiving space 46 of approximately 400 mm or more, to achieve better homogenization of the flow profile.

If in particular the width $b_2$ is below 400 mm and is for example 300 mm, then a step corresponding to the first region 158 and the second region 160 is not provided.

In the illustration of FIG. 8, this means that the second region 160 extends as far as the respective lateral duct walls 132*a* and 132*b*.

In the case of the duct device 92', steps and recesses 148 are formed in the upper duct wall 130, and only on the upper duct wall 130. The orifice 134 has an underside 164 that is located at the lower duct wall 128. Opposite, it has an upper side 166 that is located at the upper duct wall 130.

In the exemplary embodiment that is shown, the underside 164 has a rectilinear course. Recesses 148 and steps for the transition from the first region 158 to the second region 160 are located at the upper side 166. This makes it simpler to position and manufacture the duct device 92'.

Figure 10:
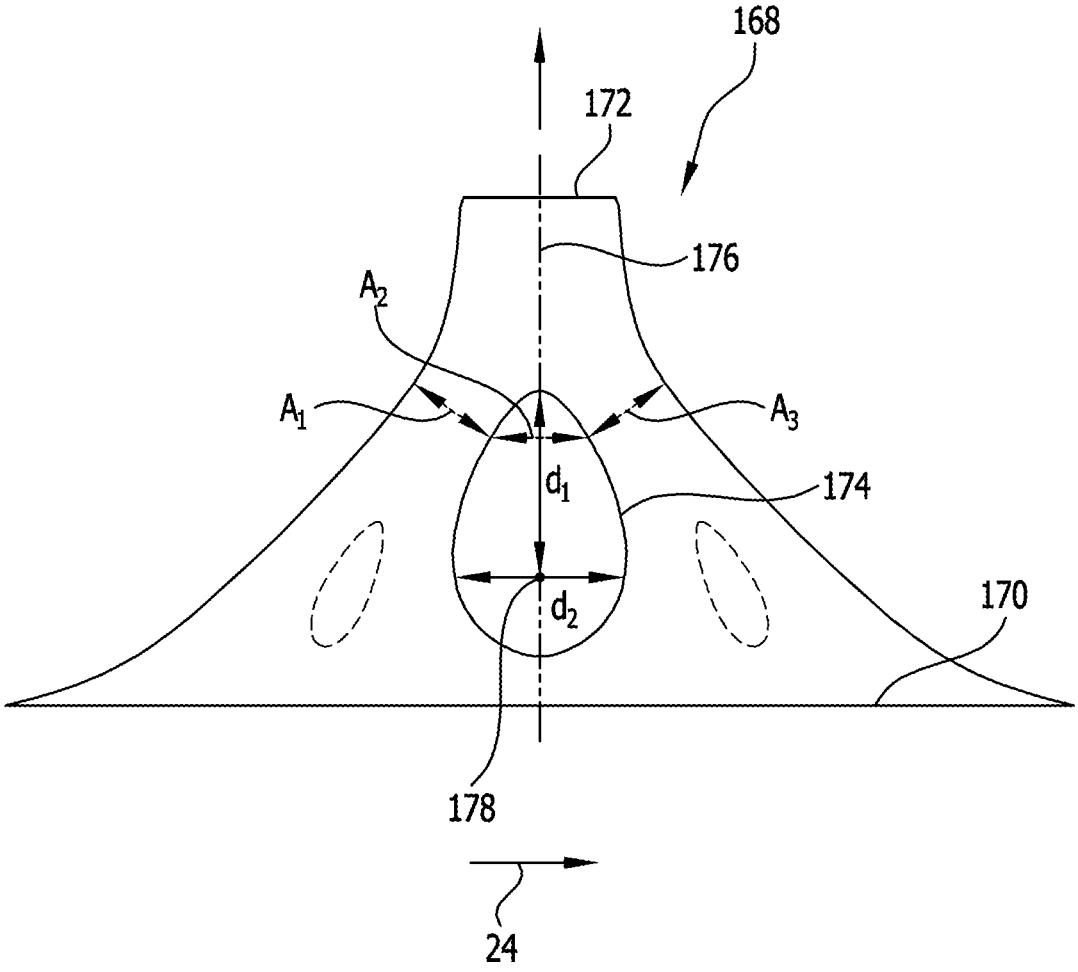
FIG. 10 shows a further exemplary embodiment of a duct device.

As indicated schematically in FIG. 10, it is also possible for a plurality of flow-diversion regions to be provided in one duct device 168. An orifice 170 and a suction connector 172 with a corresponding opening are provided. One or more flow-diversion regions 174 are located between the suction connector 172 and the orifice 170; they are at a spacing from the orifice 170 and from the suction connector 172.

A flow-diversion region 174 may in this case be formed and/or arranged symmetrically or asymmetrically relative to a center plane 176 that is perpendicular to a direction of width 24.

In one exemplary embodiment, a central flow-diversion region 174 is provided that has a geometric center point 178.

In the exemplary embodiment that is shown in FIG. 10, this geometric center point 178 is located on the center plane 176. However, it may also be at a spacing from this center plane 176.

In this context, the amount $d_1$ by which the flow-diversion region 174 extends away from the center point 178 toward the suction connector 172, designated $d_1$ in FIG. 10, is greater than a width $d_2$ of the flow-diversion region 174 in the direction of width 24 at the geometric center point 178.

This gives the flow-diversion region 174 the shape of a (hollow) egg.

In the exemplary embodiment that is shown, the flow-diversion region does not have any edges in an inner space of the duct device 168 but is rounded.

The flow-diversion region 174 forms a barrier face to flow. It is in particular provided for this barrier face $A_2$ (see FIG. 10) to form at most 90% of a total cross-sectional surface of the duct device 168, wherein the total cross-sectional surface is $A_1+A_2+A_3$ in FIG. 10. The faces $A_1$ and $A_3$ are the faces that are left clear to a certain extent by the flow-diversion region 174, and through which flow to the suction connector 172 is possible.

It has been found in that case that an effective reduction in flow resistance is produced, and a homogenized flow profile can be achieved in the receiving space 46.

FIGS. 13 to 18 show different examples of flow-diversion regions 200 that are provided with edges.

Figure 13:
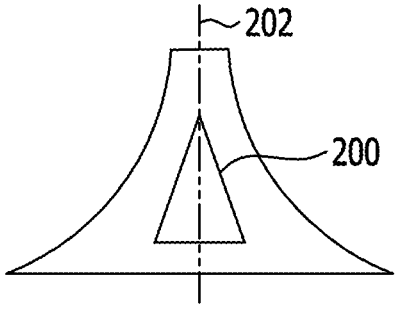
FIGS. 13 to 18 schematically show a plan view of exemplary embodiments of a duct device similar to FIG. 10, with various examples of flow-diversion regions.

In FIG. 13, the corresponding flow region 200 is triangular. It is located on a corresponding center plane 202 and is symmetrical relative thereto.

The flow-diversion region 200 has corners or edges at corresponding points on the triangle.

These corners or edges may be sharp in form, or may also be rounded.

Figure 14:
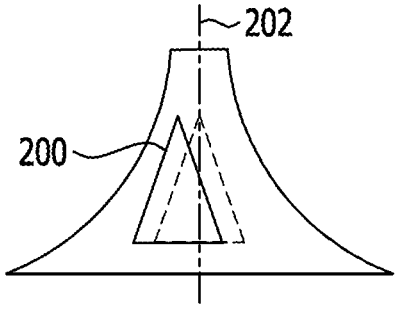

FIG. 14 shows a variant of the embodiment in FIG. 13, in which the corresponding flow-diversion region 200 is offset from the center plane 202. In this case, it may be located with a part region on the center plane 202, or all of it may be located alongside the center plane 202.

Figure 15:
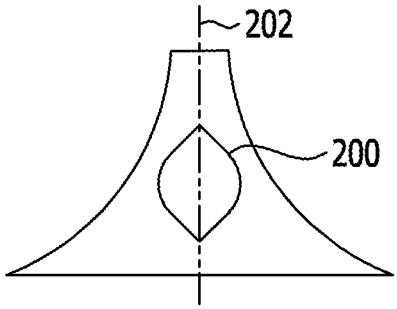

FIG. 15 shows a further exemplary embodiment of a flow-diversion region, which is located on a center plane 202 and is symmetrical relative thereto. This flow-diversion region has corners or edges on the center plane 202. Other than on the center plane 202, the flow-diversion region has no edges.

Figure 16:
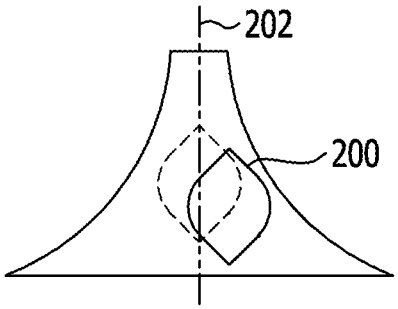

FIG. 16 shows a variant of the embodiment in FIG. 15, in which the corresponding flow-diversion region is offset from the center plane 202. In this case, it may for example also be oriented closer to the orifice.

Figure 17:
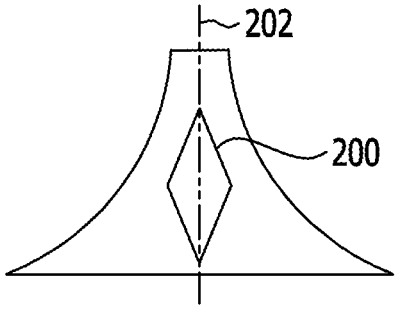
Figure 18:
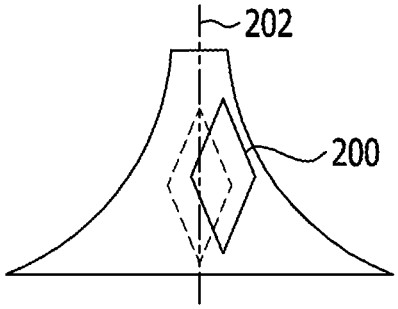

FIG. 17 shows a flow-diversion region that takes the form of a lozenge and is located on a center plane 202, and is symmetrical relative to the center plane 202. FIG. 18 shows a variant which, by comparison with the embodiment in FIG. 17, has a flow-diversion region that is offset from the center plane 202. This flow-diversion region is lozenge-shaped.

The flow-diversion region is selected such that for the respective application (for example taking into account the geometric dimensions of the floor nozzle apparatus) optimized flow conditions are produced.

According to the invention, a duct device 92, 92', 168 is provided on a floor nozzle apparatus 12, in connection with the receiving space 46 (suction duct) and the suction connector 80. It takes a form such that a homogenized flow profile is produced at the suction duct with a low flow resistance. This produces effective removal by suction.

A cross-sectional surface continuously decreases in size from the orifice toward the suction connector.

The duct device 92, 92', 168 is in this case funnel-shaped relative to the direction of width 24, wherein a reduction in width is produced from the orifice toward the suction connector.

In particular, an orifice into the receiving space 46 (suction duct) is in the form of a slit. As a result of the duct device 92, 92', 168, there is a transition to a round or oval suction connector, which has a considerably smaller width than the width of the orifice, and at the same time has a greater height than the height of the orifice.

As a result of coarse-dirt guiding-away devices 144, 146, it is possible for coarse dirt (such as small stones) to be guided away effectively even with the slit-shaped form of the orifice.

As a result of providing one or more flow-diversion regions, a purposeful influence on flow can be achieved in order to obtain a homogeneous flow profile at the suction duct (receiving space 46), in particular when there is low flow resistance.

The duct devices 92, 92', 168 have been described above in the context of use in a suction cleaning device in the form of a carpet-brush suction cleaning device. Fundamentally, they may also be used for example on floor nozzle apparatuses for a wet-and-dry vacuum cleaner.

Figure 11:
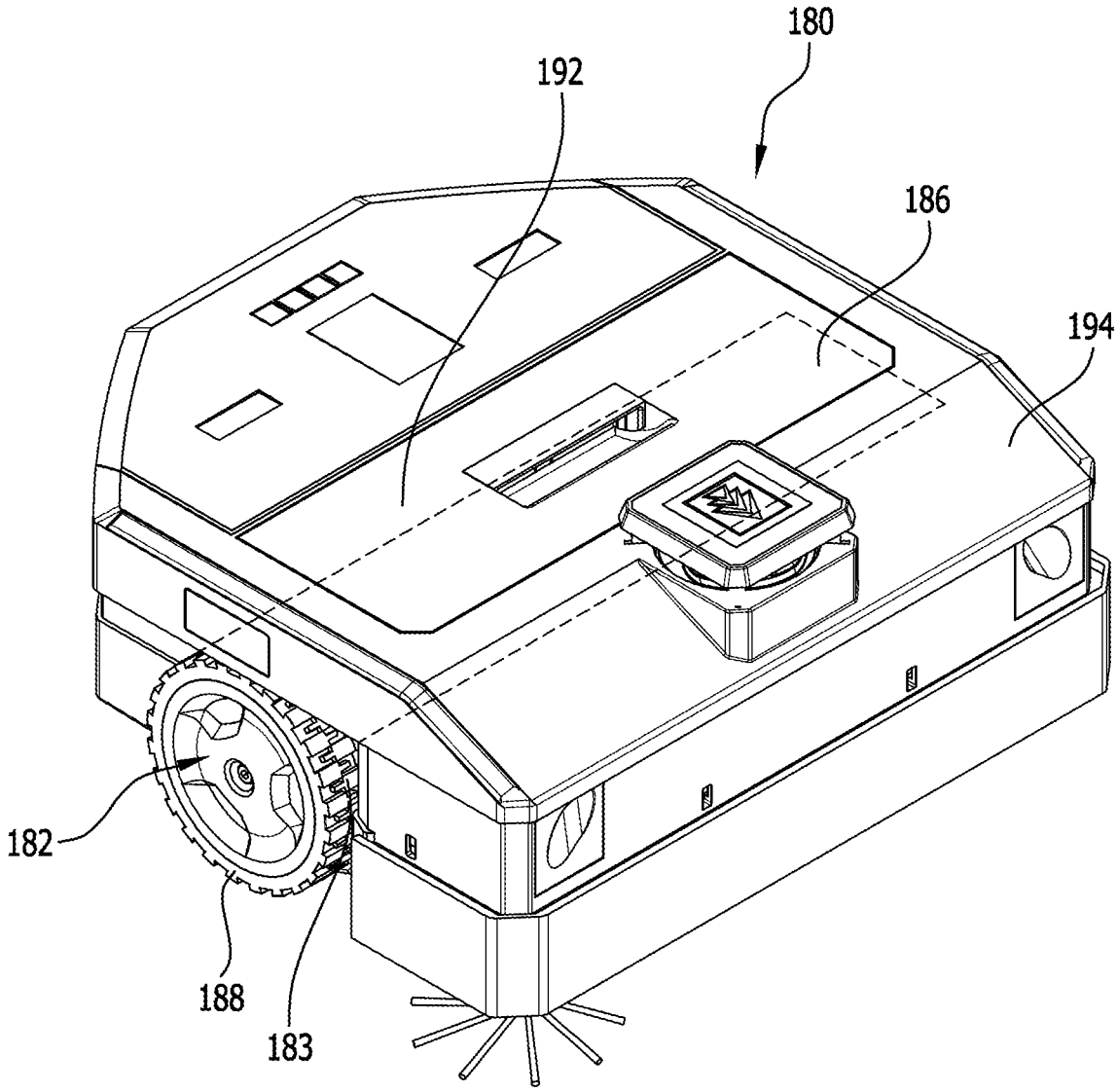
FIG. 11 shows a second exemplary embodiment of a suction cleaning device according to the invention, in the form of a self-propelling and self-steering cleaning device (cleaning robot)
Figure 12:
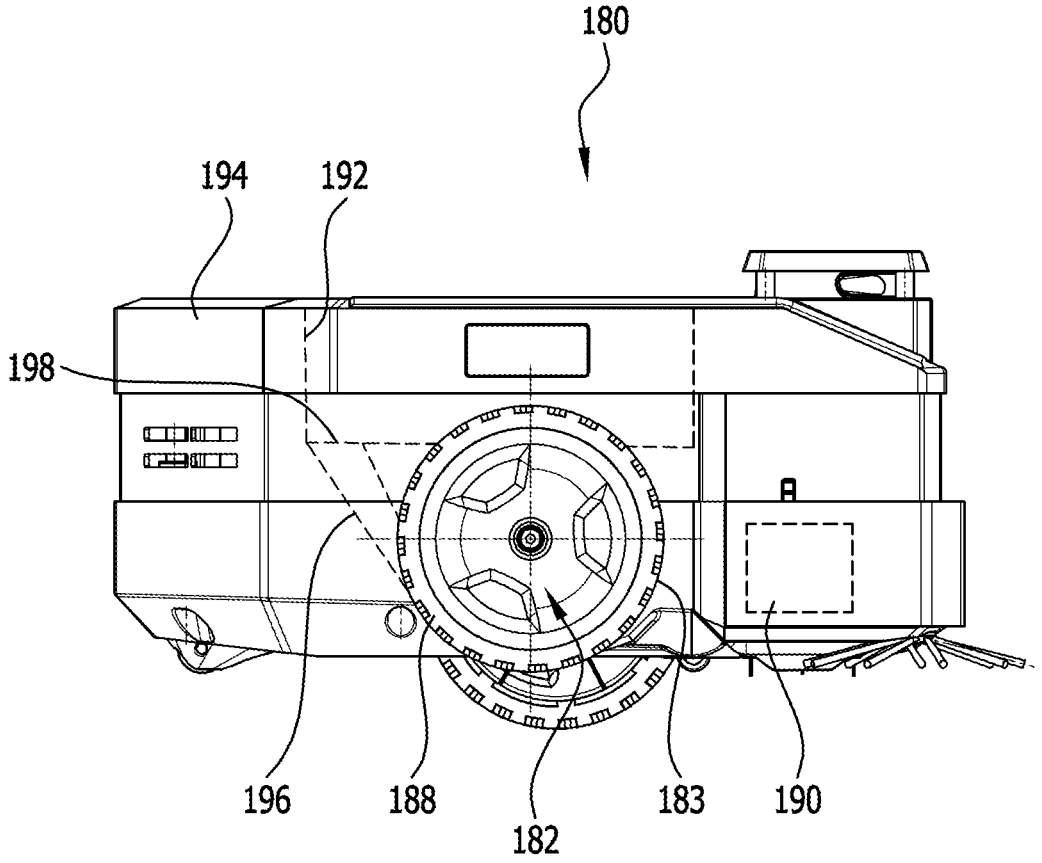
FIG. 12 shows a side view of the suction cleaning device from FIG. 11.

A further exemplary embodiment of a suction cleaning device in accordance with the invention that may be provided with a corresponding duct device is a suction cleaning device 180 (FIGS. 11, 12) in the form of a self-propelling and self-steering suction cleaning device (cleaning robot). A floor nozzle apparatus according to the invention is integrated into this suction cleaning device 180 accordingly.

The corresponding floor nozzle apparatus 182 comprises a cleaning roller 183 that is positioned such that it is driven rotatably in a receiving space 186 of a receiving chamber 188.

In this case, the cleaning roller 183 is positioned between opposing wheels 188.

A suction fan device 190 that generates a corresponding suction stream is provided.

This suction stream is in particular guided through a sucked-material container 192 that is removably seated on a body 194.

A duct device 196 opens into the receiving space 184 and basically takes the form described above.

A suction connector 198 is provided that is in connection for example with an inner space of the sucked-material container 192.

An orifice is provided by which the duct device 196 opens into the receiving space 184, and onto the suction connector 198.

The orifice is in the form of a slit, and the suction connector has an opening that is circular or oval. There is a continuous increase in size in the cross section from the orifice to the suction connector 198. The duct device 196 is funnel-shaped in a direction of width, as described above, with a width at the orifice that is considerably greater than a width of the opening in the suction connector. A height of the orifice is in this case substantially smaller than a height of the opening to the suction connector.

Fundamentally, the duct device 196 operates in the same way as described above in relation to the duct device 92, 92', 168, and basically corresponds in its construction to the duct devices that are described above.

LIST OF REFERENCE NUMERALS

10 Suction cleaning device (first exemplary embodiment)
12 Floor nozzle apparatus
14 Device body
16 Suction fan device
18 Floor
20 Body
22 Front end side
24 Direction of width
26 First transverse side
28 Second transverse side
30 Wheel device
32 First wheel
34 Second wheel
36 Further wheel device
38 First wheel
40 Second wheel
42 Direction
44 Receiving chamber
46 Receiving space
48 Cleaning roller
50 Axis of rotation
52 Bristles
54 Underside
56 Floor side
58 Opening

60 Pivot bearing
62*a* First bearing part
62*b* Second bearing part
64 Drive motor
66 Center plane
68 First half-portion
70 Second half-portion
72 Torque transmission device
74 Sliding soleplate
76 First region
78 Second region
80 Suction connector
81 Plane
82 Suction hose
84 Opening
86 Orifice normal
88 Pipe socket
90 Clean side
92 Duct device
92' Duct device
94 Orifice
96 Direction of height
98 Direction of rotation
100 Guide element
102 Orifice normal
104 Underside
106 Upper side
108*a* Lateral duct wall
108*b* Lateral duct wall
110*a* Lower duct wall
110*b* Upper duct wall
112 Inner space
114 Flow-diversion region
116 Recess
118 Peripheral wall
120 Passage
122 Securing point
124 Edge
126 Space
128 Lower duct wall
130 Upper duct wall
132*a* Lateral duct wall
132*b* Lateral duct wall
134 Orifice
136 Suction connector
138 Pipe socket
140 Flow-diversion region
142 Center plane
144 First coarse-dirt guiding-away device
146 Second coarse-dirt guiding-away device
148 Recess
150 Wall region
152 Region of increased cross-sectional surface
154 Height
156 Height
158 First region
160 Second region
162 Height
164 Underside
166 Upper side
168 Duct device
170 Orifice
172 Suction connector
174 Flow-diversion region
176 Center plane
178 Geometric center point
180 Suction cleaning device (second exemplary embodiment)
182 Floor nozzle apparatus
183 Cleaning roller
184 Receiving space
186 Receiving chamber
188 Wheel
190 Suction fan device
192 Sucked-material container
194 Body
196 Duct device
198 Suction connector
200 Flow-diversion region
202 Center plane
$b_1$ Width of orifice 94
$b_2$ Width of receiving space 46
$b_3$ Width of opening 84
b* Width of duct device
H Height of orifice 94
h Cross-sectional height of duct wall

The invention claimed is:

1. A floor nozzle apparatus, comprising
a receiving chamber having a receiving space that is open to a floor side;
at least one cleaning roller that is arranged in the receiving space and is rotatable about an axis of rotation; and
a suction connector on which a suction stream acts during operation of the floor nozzle apparatus;
wherein there is arranged between the receiving space and the suction connector a funnel-shaped duct device which opens into the receiving space by way of an orifice and which is connected to the suction connector or comprises the suction connector;
wherein the orifice has a width, in a direction of width parallel to the axis of rotation, that has at least one of the following:
the width of the orifice is at least 30% of a width of the receiving space in the direction of width;
the width of the orifice is at least twice a width of an opening in the suction connector in the direction of width,
wherein the duct device has at least one device for guiding away coarse dirt, leading into the receiving space; and
wherein, for the purpose of forming the at least one coarse-dirt guiding-away device, at least one recess is formed in a wall of the duct device.

2. The floor nozzle apparatus as claimed in claim 1, wherein the width of the orifice extends over at least 50% of the width of the receiving space.

3. The floor nozzle apparatus as claimed in claim 1, wherein a maximum height of the orifice in a direction of height transverse to the direction of width is smaller than a height of the opening in the suction connector in the direction of height.

4. The floor nozzle apparatus as claimed in claim 1, wherein the orifice takes the form of a slit having a width in the direction of width that is at least three times larger than a maximum height of the orifice in a direction of height transverse to the direction of width.

5. The floor nozzle apparatus as claimed in claim 1, wherein the opening in the suction connector has a round or oval shape.

6. The floor nozzle apparatus as claimed in claim 1, wherein a cross-sectional width of the duct device between lateral duct walls in the direction of width remains constant or decreases in size from the orifice toward the opening in the suction connector.

7. The floor nozzle apparatus as claimed in claim 1, wherein a cross-sectional height of the duct device between an upper duct wall and a lower duct wall in a direction of height transverse to the direction of width increases from the orifice toward the opening in the suction connector, wherein the lower duct wall faces the floor side and the upper duct wall is opposed to the lower duct wall.

8. The floor nozzle apparatus as claimed in claim 1, wherein a spacing between the duct device and the floor side increases from the orifice toward the suction connector.

9. The floor nozzle apparatus as claimed in claim 1, wherein the orifice is at a spacing from an underside of a body of the floor nozzle apparatus, on which the receiving chamber is arranged.

10. The floor nozzle apparatus as claimed in claim 1, wherein at least one of the following applies:

- a height of the duct device at the at least one coarse-dirt guiding-away device in a direction of height transverse to the direction of width is greater than a height of the duct device outside the at least one coarse-dirt guiding-away device;
- a height of the orifice at the at least one coarse-dirt guiding-away device is in the range between 5 mm and 30 mm;
- in relation to the direction of width, the at least one coarse-dirt guiding-away device is arranged between a lateral outer end of the duct device and a center plane that is oriented perpendicular to the direction of width;
- at least two and in particular exactly two coarse-dirt guiding-away devices are provided;
- coarse-dirt guiding-away devices are arranged symmetrically in relation to a-center plane that lies perpendicular to the direction of width.

11. The floor nozzle apparatus as claimed in claim 1, wherein at least one of the following applies:

- the at least one recess is formed in an upper side of the wall of the duct device that is remote from the floor side;
- the at least one recess forms, in respect of an inner space of the duct device, a gutter-like region of increased cross-sectional surface;
- the course of the wall of the at least one duct device is rounded at the at least one recess.

12. The floor nozzle apparatus as claimed in claim 1, wherein the orifice has an underside that faces the floor side and an upper side that is opposite the underside, with at least one of the following:

- the underside has a substantially rectilinear course;
- the upper side has a course that deviates from the rectilinear course, with at least one of i) steps and ii) bulges;
- a spacing between the underside and the upper side is in the range between 2 mm and 30 mm;
- a spacing between the underside and the upper side lies in the range between 2 mm and 15 mm outside any coarse-dirt guiding-away device present.

13. The floor nozzle apparatus as claimed in claim 1, wherein a height of the orifice in a direction of height transverse to the direction of width lies in the range between 2 mm and 30 mm, and lies in the range between 2 mm and 15 mm outside a coarse-dirt guiding-away device, if there is one.

14. The floor nozzle apparatus as claimed in claim 1, wherein the duct device has at the orifice, relative to the direction of width, a first region that is delimited by a lateral outer duct wall, and a second region that adjoins the first region, wherein the first region has a smaller height than the second region.

15. The floor nozzle apparatus as claimed in claim 14, wherein the height of the first region is in the range between 2 mm and 8 mm.

16. The floor nozzle apparatus as claimed in claim 14, wherein the height of the second region lies in the range between 5 mm and 30 mm and lies in the range between 5 mm and 15 mm outside a coarse-dirt guiding-away device, if there is one.

17. The floor nozzle apparatus as claimed in claim 1, wherein a width of the receiving space in the direction of width is at least 400 mm.

18. The floor nozzle apparatus as claimed in claim 1, wherein at least one flow-diversion region is arranged or formed in the duct device.

19. The floor nozzle apparatus as claimed in claim 18, wherein at least one of the following applies:

- the at least one flow-diversion region is formed by way of a recess in the duct device;
- the at least one flow-diversion region is at a spacing from the orifice;
- the at least one flow-diversion region is at a spacing from the suction connector;
- the at least one flow-diversion region lies on a center plane;
- the at least one flow-diversion region is symmetrical or asymmetrical relative to a center plane of the duct device, wherein the center plane is at least one of i) oriented, ii) arranged and iii) formed perpendicular to the direction of width;
- the at least one flow-diversion region has a geometric center point, and an extent of the at least one flow-diversion region away from the center point and perpendicular to the direction of width, wherein this extent is greater than a width of the at least one flow-diversion region parallel to the direction of width at the geometric center point;
- a cross-sectional surface of the at least one flow-diversion region, which forms a barrier face for flow, is at most 90% of a total cross section of the duct device including the at least one flow-diversion region;
- the at least one flow-diversion region has no edges or is provided with edges;
- the at least one flow-diversion region is in the shape of an egg or droplet.

20. The floor nozzle apparatus as claimed in claim 18, wherein a drag coefficient for the at least one flow-diversion region is less than or equal to 3 with a Reynolds number of 2,300.

21. The floor nozzle apparatus as claimed in claim 1, wherein the duct device is arranged above a sliding soleplate, relative to the floor side.

22. The floor nozzle apparatus as claimed in claim 1, wherein a drive motor for the at least one cleaning roller is arranged on a body of the floor nozzle apparatus, and wherein the drive motor is positioned between the suction connector and the orifice of the duct device.

23. The floor nozzle apparatus as claimed in claim 1, wherein the at least one cleaning roller is a brush roller or a textile roller.

24. The floor nozzle apparatus as claimed in claim 1, wherein the duct device is formed in one piece.

25. The floor nozzle apparatus as claimed in claim 1, wherein, during a cleaning operation of the floor nozzle apparatus, the at least one cleaning roller rotates and a suction stream acts on the suction connector.

26. A suction cleaning device, comprising a suction fan device and a floor nozzle apparatus, said floor nozzle apparatus comprising a receiving chamber having a receiving space that is open to a floor side;

at least one cleaning roller that is arranged in the receiving space and is rotatable about an axis of rotation; and a suction connector on which a suction stream acts during operation of the floor nozzle apparatus;

wherein there is arranged between the receiving space and the suction connector a funnel-shaped duct device which opens into the receiving space by way of an orifice and which is connected to the suction connector or comprises the suction connector; and wherein the orifice has a width, in a direction of width parallel to the axis of rotation, that has at least one of the following:

the width of the orifice is at least 30% of a width of the receiving space in the direction of width;

the width of the orifice is at least twice a width of an opening in the suction connector in the direction of width; and wherein the suction fan device is fluidically connected to the suction connector, wherein the duct device has at least one device for guiding away coarse dirt, leading into the receiving space; and wherein, for the purpose of forming the at least one coarse-dirt guiding-away device, at least one recess is formed in a wall of the duct device.

27. The suction cleaning device as claimed in claim 26, wherein said suction cleaning device takes the form of a carpet-brush suction cleaning device.

28. The suction cleaning device as claimed in claim 26, wherein said suction cleaning device takes the form of an upright device that is operable by a user who is standing up.

29. The suction cleaning device as claimed in claim 26, wherein said suction cleaning device takes the form of a self-propelling and self-steering cleaning device.

* * * * *